United States Patent [19]

Vesce et al.

[11] Patent Number: 4,800,331

[45] Date of Patent: Jan. 24, 1989

[54] LINEAR CURRENT LIMITER WITH TEMPERATURE SHUTDOWN

[75] Inventors: Richard V. Vesce, East Hampton, Conn.; Andrew C. Reck, St. Joseph, Mich.

[73] Assignee: United Technologies Corporation, Hartford, Conn.

[21] Appl. No.: 13,758

[22] Filed: Feb. 12, 1987

[51] Int. Cl.[4] ..... G05F 1/573

[52] U.S. Cl. ..... 323/277; 323/279; 361/106

[58] Field of Search ..... 361/93, 106; 323/277, 323/279

[56] References Cited

U.S. PATENT DOCUMENTS

| | | | |
|---|---|---|---|
| 3,723,774 | 3/1973 | Rogers | 323/277 |
| 4,019,096 | 4/1977 | Bullinga | 323/277 |
| 4,278,930 | 7/1981 | Rogers | 323/277 |
| 4,428,016 | 1/1984 | Brasfield | 361/106 |
| 4,495,536 | 1/1985 | Bynum | 323/277 |
| 4,672,302 | 6/1987 | DeShazo | 323/277 |

*Primary Examiner*—Peter S. Wong
*Assistant Examiner*—J. Sterrett
*Attorney, Agent, or Firm*—Francis J. Maguire, Jr.

[57] ABSTRACT

A high efficiency current limit circuit comprises a current sensor, a control unit responsive to the current sensor for providing a control signal to a solid-state series pass element which limits load current. A thermal safety circuit provides overtemperature circuit protection. Together, the current limit circuit and thermal safety circuit provide continuous short circuit protection (of indefinite time duration) with automatic recovery upon removal of the short.

8 Claims, 1 Drawing Sheet

LINEAR CURRENT LIMITER WITH TEMPERATURE SHUTDOWN

DESCRIPTION

1. Technical Field

This invention relates to current overload protection and, more particularly, to an efficient current limit circuit.

2. Background Art

Whenever the load current in any electronic circuit increases beyond its safe operating level, damage may occur unless some type of current limit protection is provided.

The simplest form of over-current protection is the two-terminal passive fuse. When an over-current condition occurs, the fuse "blows" typically by melting and thus literally provides an open circuit in the power line. Some of the problems with this type of device are the inability of the fuse to reset itself, the inability to provide constant blow characteristics over temperature, the inability to prevent surge currents from prematurely blowing the fuse, inherently poor electrical reliability, poor susceptibility to mechanical vibrations, and finite life expectancy.

Another prior art approach for current protection is pulse current limiting, in which a controllable semiconductor device is utilized as a series pass element which can be controlled in the "shorted" or "open" condition. During an overload or short circuit condition, the pass element is "pulsed" open or shorted by charging and discharging an R-C network connected to the drive circuitry of the pass element, thereby limiting the output current. Although this type of protection will reset upon removal of the overload condition, its use is limited due to excessive series voltage drop (2–3 volts), excessive power dissipation during normal operation, and the inability to start up into large capacitive loads. Furthermore, the oscillating characteristics of the circuit can generate undesirable noise and transients on the power lines and the current limit trip levels are line voltage and temperature dependent.

Still another prior art approach is current "foldback" in which the limitation on the output current magnitude is directly related to the load impedance. A problem with both the foldback and pulse current limiting approaches is that with such circuits, "turn-on" into capacitive or lamp loads "looks" like a shorted load and the circuits act to limit the turn-on current to very low levels.

DISCLOSURE OF THE INVENTION

An object of the present invention is to provide a high efficiency current limit circuit.

Another object of the present invention is to provide minimum heat dissipation for high reliability in a current limit circuit.

Another object of the present invention is to provide a current limit circuit which can withstand high voltage surges.

Another object of the present invention is to provide a current limit circuit having its current limiting point selectable and independent of the input voltage selected.

Another object of the present invention is to provide a current limit circuit having a low input-to-output voltage differential.

Another object of the present invention is to provide a current limit circuit having linear, low-noise operation.

Another object of the present invention is to provide a current limit circuit having the ability to turn on with any value or combination of capacitive, inductive or resistance loads.

Another object of the present invention is to provide a current limit circuit with the ability to protect itself during continuous short circuit conditions of indefinite time duration with automatic recovery to normal operation upon removal of the short.

Another object of the present invention is to provide a thermally protected current limit circuit.

Another object of the present invention is to provide selectable thermal shutdown trip point independent of the input voltage.

Another object of the present invention is to provide a high efficiency thermal safety circuit.

Another object of the present invention is to provide a thermal safety circuit having the capacity for floating operation and able to withstand high voltage surges.

Another object of the present invention is to provide a thermal safety circuit having its trip point selectable and independent of the input voltage selected.

Another object of the present invention is to provide a thermal safety circuit with the ability to provide continuous short circuit protection with automatic recovery upon removal of the short.

Another object of the present invention is to provide a thermal safety circuit with hysteresis, in order to avoid undue cycling.

According to a first aspect of the present invention, a current limiter is provided for limiting load current delivered from a voltage source to a load. The current limiter comprises a bipolar transistor having its collector connected via a current sensing circuit, to the voltage source for conducting load current from the voltage source, through the transistor via the collector and the emitter for delivery to the load. The base of the transistor is controlled by the drain of a field effect transistor (FET) which is also connected, at its source node, to the voltage source via a current sensing circuit. The voltage at the gate of the FET is controlled by a control signal from a current limit control means. By varying the voltage at the gate, the current limit control means causes the FET to drive the bipolar transistor in its saturation region for load currents less than a selected magnitude and into its cutoff region for load currents greater than the selected magnitude. The current limit control means is itself controlled by a sensed signal indicative of the magnitude of the load current conducted between the voltage source and the load.

In further accord with the present invention, the current limiter is thermally protected by means of a thermal sensor located on, or at least in the vicinity, of the bipolar transistor for providing a temperature signal indicative of the temperature of the bipolar transistor. A shutdown control means, responsive to the temperature signal and to a selected temperature reference signal compares the two temperature signals and providing a shutdown signal to the current limit control means in the presence of a temperature signal having a magnitude indicative of a temperature greater than the selected temperature for causing the current limit control means to provide the control signal at a magnitude which in turn causes the FET to provide a base drive signal at a magnitude which in turn causes the bipolar transistor to stop conducting current from the voltage source to the load. The shutdown control means removes the shutdown signal in the presence of the magnitude of the temperature signal falling below the magnitude of the selected temperature reference signal. A thermal lag, inherent in the mass of the transistor case and the thermistor provides a useful hysteresis such that the case temperature will actually fall below the thermal trip point temperature before permitting turn-on to occur.

In still further accord with the present invention, the current sensing means may be a resistor in a bridge circuit which provides a current sense signal and a reference signal to a current limit control means comprising an operational amplifier.

In accordance with a second aspect of the present invention, a thermal safety circuit is provided for cutting off load current delivered from a voltage source to a load. It comprises a bipolar transistor, connected at its collector to the input voltage source and at its emitter to the load. The magnitude of the load current conducted from the voltage source between the collector and emitter to the load is controlled by a base drive signal at the base of the transistor. A control means is normally responsive to a current sense signal indicative of the magnitude of the load current for providing a control signal which controls the base drive signal. However, according to this second aspect, the control means is also responsive to a shutdown signal for providing the base drive signal at a level for cutting off load current delivered from the voltage source to the load altogether. This is accomplished by means of a shutdown signal provided to the control means by a signalling means responsive to a temperature signal and to a temperature reference signal indicative of a selected temperature. The temperature signal is from a thermal sensor responsive to the temperature of the bipolar transistor and is indicative of the temperature of the transistor. The shutdown signal is thus provided in the presence of the magnitude of the temperature signal being greater than the magnitude of the reference signal.

In further accord with this second aspect of the present invention, the signalling means provided in the thermal safety circuit may comprise a resistance bridge with the thermal sensor in one leg thereof and the temperature reference signal in another leg. An operational amplifier is then responsive to the temperature signal and to the temperature reference signal for providing the shutdown signal.

In still further according with this second aspect of the present invention, the control means of the thermal safety circuit may comprise a field effect transistor (FET) responsive at its source to a voltage from the voltage source for providing a base drive signal at its drain in response to a control signal at its gate. A current sensing means, responsive to a voltage from the voltage source, provides a sensed signal indicative of the magnitude of the current conducted between the voltage source and the load. Means responsive to the magnitude of the sensed load current signal provides the control signal and is responsive also to the shutdown signal for providing the control signal at a magnitude which causes the FET to provide a base drive signal having a magnitude which cuts off load current.

The "smart fuse," according to the present invention, overcomes present day limitations and advances current limiting art by providing a high efficiency, thermally protected, current limit circuit which provides continuous overload protection by limiting the maximum current to a programmable, safe value for any overload or short circuit condition of any time duration with automatic recovery to normal operation upon removal of the fault condition. Outstanding features of the present invention include high efficiency (approximately 97%), high reliability (minimum heat dissipation), floating operation to withstand high voltage surges, programmable current limit and thermal shutdown trip points independent of the input voltage, low input-to-output voltage differential (without limitation, less than 0.8 V at 2.0 amps), completely linear low noise operation, the ability to charge any value of capacitive loads, and the ability to provide continuous short circuit protection with automatic recovery upon removal of the short.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
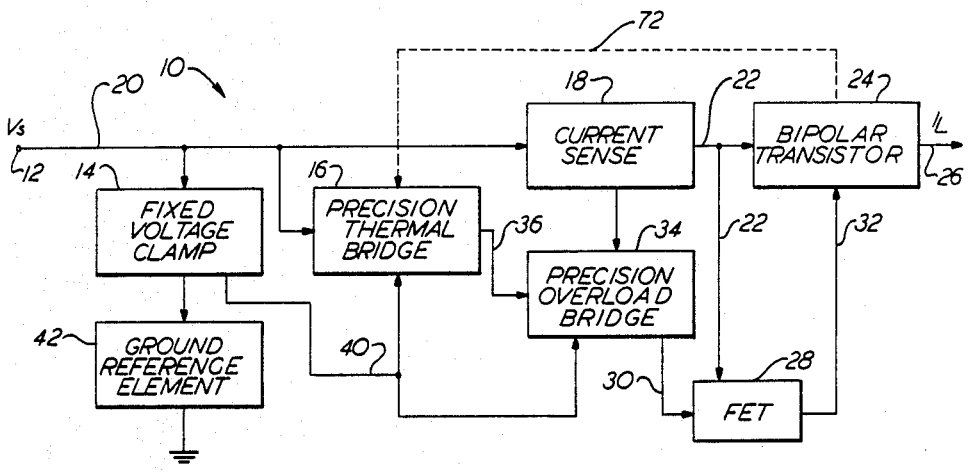
FIG. 1 is a block diagram illustration of a solid-state resettable current limit circuit with thermal protection, according to both aspects of the present invention.

FIG. 1 is a simplified block diagram illustration of a solid-state resettable current limit circuit 10 or "smart fuse" according to the present invention. Voltage from a voltage source ($V_S$) is applied at an input mode 12 to a fixed voltage clamp 14, a precision thermal bridge 16, and a current sense circuit 18. Current conducted from the node 12 on a line 20 passes through the current sensor 18 and is delivered on a line 22 to a bipolar transistor 24 which, during normal operation, is driven in its saturation mode to conduct load current ($I_L$) on a line 26 to a load (not shown).

During normal operation, a field effect transistor (FET) 28 is "on" and acts as a base "driver" in order to drive the bipolar pass transistor 24 into saturation in order to efficiently conduct current. The FET is controlled at its gate by a control signal on a line 30. Thus, the transistor base drive current is provided via line 22, through the FET source-to-drain, and out again onto a line 32 into the base of the bipolar transistor 24 and out its emitter onto line 26, thereby driving the bipolar transistor with nearly zero power dissipation. Since the bipolar transistor allows high output currents with low saturation voltage, low overall power dissipation is the resultant of this design, under normal operation.

The output current ($I_L$) is monitored by a low voltage current sense element 18 which may be part of a precision bridge circuit 34. Under a fault condition, the bridge circuit 34 detects an overload current in the current sense element 18 and commands a decrease in base drive to the bipolar pass transistor 24 via the control signal on line 30 and FET 28 to maintain a fixed limit on the output current for any value of output impedance. This "limit" feature, as opposed to "foldback" and "pulse limiting" techniques, allows the circuit to start up and recover from a direct short for any values of capacitive, inductive and resistive loads.

Under a short circuit condition, the power dissipation in the bipolar pass transistor 24 increases as a direct function of the input voltage times the fixed output current limit value. A second precision bridge circuit 16 utilizes a temperature sensor, e.g., a thermistor, to monitor the case temperature of the pass transistor 24. The thermistor may be mounted on the transistor's case, providing a direct path 72 for heat flow. The circuit 16 commands a "shutdown" signal on a line 36 to the pass transistor via, by way of example, the over current bridge 34 and the FET 28, in the event that the case temperature exceeds a predetermined "turnoff" threshold level. With inherent thermal hysteresis provided by the masses of the case and the sensor, "toggeling" is prevented at the threshold point; thus, the transistor will automatically be turned "on" again only when the case temperature drops a few degrees below the "turn-off" threshold level. This thermal safety circuit aspect of the present invention provides protection against an overload or direct short condition of indefinite time duration and also provides automatic recovery to normal operation upon the removal of the fault.

Both precision bridge circuits 16, 34 are clamped to the input voltage on the line 20 by a fixed voltage clamp 14 via a signal line 40 and referenced to ground through a high impedance element 42. This unique circuit feature provides safe operation for high input voltage applications. The input voltage is limited only by the maximum voltage rating of the driver and pass transistors. This feature also provides voltage transient protection and precision current and thermal trip thresholds independent of input line voltage.

Figure 2:
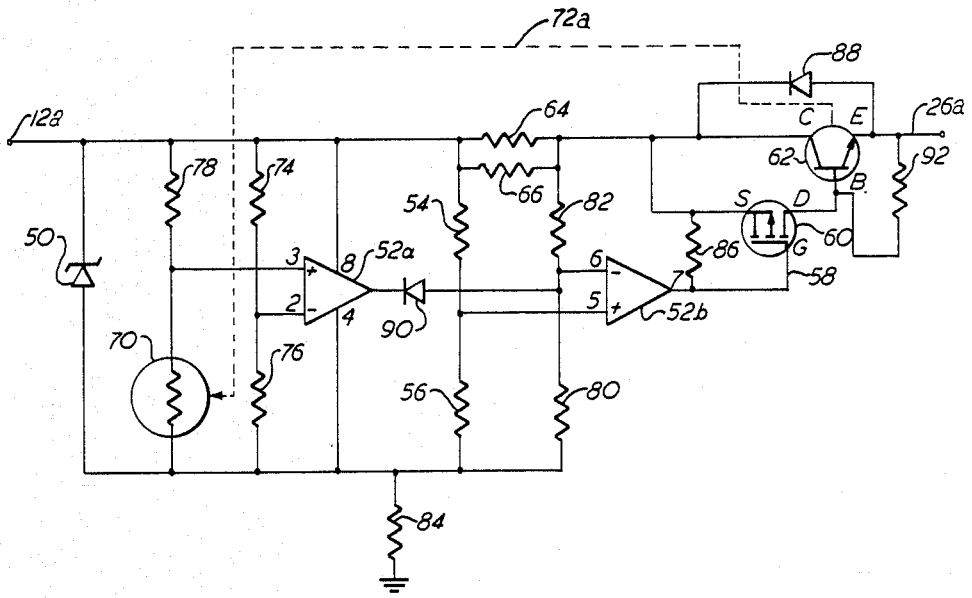
FIG. 2 is a more detailed schematic diagram of another embodiment of the present invention, similar to that shown in FIG. 1.

FIG. 2 shows a more detailed schematic diagram of another embodiment of the present invention similar to that shown in FIG. 1. The particular embodiment shown in FIG. 2 assumes a positive input voltage at a node 12*a*. For this reason, the bipolar transistor is a NPN type and the FET is a p-channel type. It will be understood, however, that for a negative voltage supply the transistor would be of the PNP type and the FET would be an n-channel type. Other minor adjustments to the circuit shown would have to be made also, as will be understood by those skilled in the art.

When positive input voltage is applied at node 12*a*, a zenor diode 50, (which may, for example, be a 12 V 1N9638, or any voltage necessary to power op amps 52*a* and *b*), clamps the input supply voltage to both halves 52*a*, 52*b* of an operational amplifier pair, which may, without limitation, be a National Semiconductor LM158, to 12 volts, e.g., plus or minus 5%. Under this condition, a voltage divider comprising resistors 54, 56, which may each have a value of 20K at, for example, a precision of 0.1%, sets the op amp 52*b* output on a control signal line 58 "low" which turns "on" FET driver 60 and allows a bipolar pass transistor 62 to conduct.

The output load current delivered on a line 26*a* is monitored by series resistors 64, 66 which, for example, may each have a value of 0.1 ohm at an accuracy of 1%, together developing a 50 to 120 mV drop at the overload trip point. Of course, resistors 64, 66 could be a single 50 milliohm resistor instead of two 100 milliohm resistors. Op amp 52*b* linearly controls the gate-to-source voltage on the FET driver 60 which limits the current through the pass transistor 62. As the output load current increases beyond the overload trip point, e.g., 2.5 amps, the output current on line 26*a* is maintained as the output voltage linearly decreases. If the output becomes a short circuit, the output voltage approaches zero which causes the voltage across the transistor 62 to essentially equal the input voltage. The extra power in the transistor 62 is dissipated in the form of heat which causes a temperature rise in the case thereof.

A thermistor 70 is mounted directly on the case of the transistor 62 for good heat transfer (as indicated by the dashed lines 72 in FIG. 1 and 72*a* in FIG. 2) and monitors its temperature rise. As the case temperature of the transistor 62 increases, the resistance of the thermistor 70 drops, causing the voltage on the positive input of op amp 52*a* to decrease. This assumes bridge resistance values of 20K in a resistor 74, 2K in a resistor 76, 20K in a resistor 78, and values of from 2K at 100° C. to 30K at 25° C. in thermistor 70 which, for example, may be a Yellow Springs 44909 type. At the designed thermal shutdown trip point, the voltage on the positive input of op amp 52*a* drops below the reference voltage on the negative input which forces the output of the op amp low. This turns "off" FET 60 (gate-to-source voltage equaling zero) which removes the base drive from transistor 62 and the load current goes to zero.

With zero current through transistor 62, the case temperature decreases until the voltage on the positive input of op amp 52*a* again rises above the voltage on the negative input, which allows current to flow. This temperature cycling protects the bipolar pass transistor from thermal damage and will continue indefinitely until the fault condition is corrected.

The current limit trip point can be easily adjusted by changing the value of a resistor 80 which may have a value, for example, of 20.5K and which, together with a resistor 82 which may have a value, for example of 20K, and resistors 54, 56, 64, 66 provide the current sense 18 and precision overload bridge 34 functions shown in FIG. 1. They, together with resistors 54 and 56 may also have precisions of 0.1%. However, it will be understood that the resistive values, their tolerances, and the types of devices cited herein are merely a design choice.

Some of the other values and components selected for the design of FIG. 2 are, without limitation, a 2.1K resistor 84 for the ground reference element, a 20K resistor 86, diodes 88, 90 of the type 1N5815, and a 2K resistor 92.

The design of FIG. 2 was tested using input line variations from 14 V to 30 V DC and it was found that the design current limit trip level of 2.5 amps was virtually constant over that range of input line variations. Also, the temperature hysteresis during the thermal shutdown cycle was between 106° and 89° C. with a continuous direct short circuit on the output. Under normal operating conditions, the measured input to output drop was less than 0.8 volts and the measured circuit efficiency was better than 97%.

Thus, the state of the art of current limiting technology is advanced by providing a maintenance free, highly efficient, highly reliable, automatically resettable, current limiter. The outstanding features of this circuit are precision trip levels independent of line, load, and temperature; start-up capabilities to drive large capactive loads; internal thermal protection to survive short circuit conditions of indefinite time duration; input spike and transient voltage protection; and, low input to output differential voltage drop for universal applications.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

We claim:

1. A current limiter for limiting load current delivered from an input voltage source to a load, comprising:

current sensing means, responsive to the input voltage from the voltage source for providing a sensed signal indicative of the magnitude of the load current conducted between the voltage source and the load;

a bipolar transistor, responsive at its collector node to the input voltage via said current sensing means and responsive at its base node to a base drive signal for controlling the magnitude of load current conducted from the voltage source between said collector and the emitter node of said bipolar transistor to the load;

a field effect transistor, responsive at its source node to the input voltage via said current sensing means for providing said base drive signal at its drain node in response to a control signal at its gate for driving said bipolar transistor in its saturation region for load currents less than a selected magnitude and into its linear region for load currents greater than said selected magnitude; and current limit control means responsive to the magnitude of said sensed signal for providing said control signal.

2. The current limiter of claim 1, further comprising:

a thermal sensor, responsive to the temperature of said bipolar transistor for providing a temperature signal indicative thereof; and shutdown control means, responsive to said temperature signal and to a selected temperature reference signal for providing, in the presence of a temperature signal having a magnitude indicative of a temperature greater than the selected temperature, a shutdown signal to said current limit control means for causing said current limit control means to provide said control signal having a magnitude which in turn causes said field effect transistor to provide a base drive signal which in turn causes said bipolar transistor to stop conducting current from the voltage source to the load, said shutdown control means removing said shutdown signal in the presence of the magnitude of the temperature signal falling below the magnitude of said selected temperature reference signal.

3. The current limiter of claim 1, wherein said current sensing means is a resistor in a bridge circuit and wherein said current limit control means is an operational amplifier.

4. A current limiter for limiting load current delivered from an input voltage source to a load:

current sensing means, responsive to the input voltage source for conducting the load current and providing a sensed signal indicative of the magnitude thereof;

control means, responsive to the magnitude of the sensed signal for providing a control signal for controlling the magnitude of the load current; and a solid-state series pass element, responsive to the load current and responsive to said control signal for providing said load current by operating in its saturation region for load currents less than a selected magnitude and in its linear region for load currents greater than said selected magnitude.

5. The limiter of claim 4, further comprising:

a thermal sensor, responsive to the temperature of said series pass element for providing a temperature signal indicative thereof;

signalling means, responsive to said temperature signal and to a temperature reference signal indicative of a selected temperature, for providing a shutdown signal in the presence of the magnitude of said temperature signal being greater than the magnitude of said reference signal; and wherein said control means is responsive to said shutdown signal for providing said control signal at a magnitude which causes said series pass element to cutoff current conducted from the input voltage source to the load for so long as said magnitude of said temperature signal is sensed as being greater than the magnitude of said reference signal.

6. The limiter of claim 4, further comprising:

clamping means, responsive to the input voltage for providing the input voltage of the source as a fixed voltage impressed thereacross; and ground reference means, responsive to said fixed voltage for elevating the input voltage of the source above ground potential.

7. A current limiter for limiting load current delivered from an input voltage source to a load, comprising:

current sensing means, responsive to the input voltage from the voltage source for providing a sensed signal indicative of the magnitude of the load current conducted between the voltage source and the load;

a solid-state series pass element, responsive to the input voltage via said current sensing means and responsive to a control signal for controlling the magnitude of load current conducted from the voltage source to the load by operating said series pass element in its saturation region for load currents less than a selected magnitude and such that the load current is limited for load currents greater than said selected magnitude by operating said series pass element in its linear region;

current limit control means, responsive to the magnitude of said sensed signal for providing said control signal;

a thermal sensor, responsive to the temperature of said series pass element for providing a temperature signal indicative thereof;

signalling means, responsive to said temperature signal and to a temperature reference signal indicative of a selected temperature for providing a shutdown signal in the presence of the magnitude of said temperature signal greater than the magnitude of said reference signal; and wherein said current limit control means is also responsive to said shutdown signal for providing said control signal at a magnitude which causes said series pass element to cutoff current conducted from the voltage source to the load for so long as said magnitude of said temperature signal is sensed as being greater than the magnitude of said reference signal.

8. A current limiter for limiting load current delivered from an input voltage source to a load, comprising:

clamping means, responsive to the input voltage for providing a fixed voltage impressed thereacross;

ground reference means, responsive to said fixed voltage for elevating said fixed voltage above ground potential;

current sensing means, responsive to said fixed voltage for providing a sensed signal indicative of the magnitude of the load current conducted between the voltage source and the load;

a solid-state series pass element, responsive to said fixed voltage via said current sensing means and responsive to a control signal for controlling the magnitude of load current conducted from the voltage source to the load such that the load current is limited for load currents greater than a selected magnitude; and current limit control means, responsive to the magnitude of said sensed signal for providing said control signal.

* * * * *